United States Patent [19]

Yasuoka

[11] 4,412,111

[45] Oct. 25, 1983

[54] LIMIT SWITCH MECHANISM

[75] Inventor: Hirotoshi Yasuoka, Nagoya, Japan

[73] Assignee: Mitsubishi Denki Kabushiki Kaisha, Tokyo, Japan

[21] Appl. No.: 394,861

[22] Filed: Jul. 2, 1982

[30] Foreign Application Priority Data

Jul. 21, 1981 [JP] Japan ..... 56-108305[U]

[51] Int. Cl.[3] ..... H01H 3/16; H01H 21/28

[52] U.S. Cl. ..... 200/47; 200/153 LB

[58] Field of Search ..... 200/47, 153 LB, 153 L, 200/153 T, 153 P, 328, 336, 337

[56] References Cited

U.S. PATENT DOCUMENTS

| | | | |
|---|---|---|---|
| 2,541,299 | 2/1951 | Shannon | 200/153 P |
| 2,786,904 | 3/1951 | Hewes et al. | 200/153 LB |
| 3,060,296 | 10/1962 | Ryan | 200/153 LB |
| 3,105,885 | 10/1963 | Roeser | 200/153 T |
| 3,626,119 | 12/1971 | Fry | 200/47 |
| 3,699,283 | 10/1972 | Ustin | 200/47 |
| 3,918,020 | 11/1975 | DuRocher | 200/153 LA |

FOREIGN PATENT DOCUMENTS

| | | | |
|---|---|---|---|
| 1004031 | 9/1965 | United Kingdom | 200/47 |
| 587516 | 1/1978 | U.S.S.R. | 200/153 LB |

OTHER PUBLICATIONS

IBM Technical Disclosure Bulletin, vol. 19, No. 10, Mar. 1977.

*Primary Examiner*—Ernest G. Cusick

*Attorney, Agent, or Firm*—Oblon, Fisher, Spivak, McClelland & Maier

[57] ABSTRACT

A limit switch mechanism includes a limit switch disposed in confronting relation to a cam mounted on a switch drive shaft. The limit switch is actuatable by the cam when the switch drive shaft is angularly moved about its own axis through a predetermined angle. The limit switch has a longitudinal axis extending substantially parallel to the axis of the switch drive shaft, and is disposed in the vicinity of the switch drive shaft. The limit switch is actuated by being pushed by a limit switch arm extending from a cam arm actuatable by the cam and located more closely than the cam arm to the switch drive shaft.

5 Claims, 11 Drawing Figures

LIMIT SWITCH MECHANISM

BACKGROUND OF THE INVENTION

1. Field of the Invention

The present invention relates to a limit switch mechanism, and more particularly to a limit switch mechanism in which limit switches can be actuated by a cam mounted on a drive shaft.

2. Description of the Prior Art

FIGS. 1 and 2 of the accompanying drawings show a conventional limit switch mechanism as assembled in an electrically operated shutoff valve for controlling the flow of a fluid. The valve includes an output shaft 1 rotatable in opposite directions through about 90 degrees by a motor 2 through a planetary gear mechanism. A switch drive shaft 3 has on its right-hand end a sector gear 4 held in mesh with a gear 5 on the output shaft 1. The switch drive shaft 3 is thus rotatable in opposite directions through about 90 degrees in synchronism with the output shaft 1. The switch drive shaft 3 has a cam 6 fixed to its left-hand end. A switch arm 7 is shaped as shown in FIGS. 3(A), 3(B) and 3(C), and has a pair of arms 7*a*, 7*b* extending in confronting relation one on each side of the cam 6.

A pair of limit switches 8*a*, 8*b* are positioned so that their longitudinal axes extend normally to the axis of the switch drive shaft 3, the limit switches 8*a*, 8*b* being located outwardly of the arms 7*a*, 7*b*, respectively. The limit switches 8*a*, 8*b* are thus located laterally of each other. When the cam 6 is angularly moved in opposite directions, the arms 7*a*, 7*b* are displaced away from each other to actuate the limit switches 8*a*, 8*b*, respectively.

The limit switches 8*a*, 8*b* are positioned with respect to the switch drive shaft 3 as follows: The limit switches 8*a*, 8*b* project downwardly by a dimension $h_1$ and upwardly by a dimension $h_2$ beyond the switch drive shaft 3. The limit switches 8*a*, 8*b* have pushbuttons 8*a*-1, 8*a*-2, respectively, each spaced from the switch drive shaft 3 by a dimension $w_1$. The prior limit switch mechanism is therefore disadvantageous in that the limit switches 8*a*, 8*b* take up a relatively large space around the switch drive shaft 3, and hence the mechanism is large in size and heavy in its entirety.

SUMMARY OF THE INVENTION

It is an object of the present invention to provide a limit switch mechanism which includes limit switches having longitudinal axes extending substantially parallel to the axis of a switch drive shaft, and hence which takes up a relatively small space for the limit switches.

Another object of the present invention is to provide a limit switch mechanism which is small in size and lightweight.

The foregoing and the other objects of the present invention have been attained by providing a limit switch mechanism for coaction with a driver to limit movement of the driver to a predetermined range, said limit switch mechanism comprising: a shaft operatively connectable to the driver and movable in response to movement of the driver; a cam mounted on one end of said shaft for movement therewith; and a switch disposed adjacent to said cam and actuatable in response to movement of said cam for limiting the movement of said driver, said switch having a longitudinal axis extending along the axis of said shaft.

The above and other objects, features and advantages of the present invention will become more apparent from the following description when taken in conjunction with the accompanying drawings in which a certain preferred embodiment of the invention is shown by way of illustrative example.

DETAILED DESCRIPTION OF THE PREFERRED EMBODIMENTS

Figure 1:
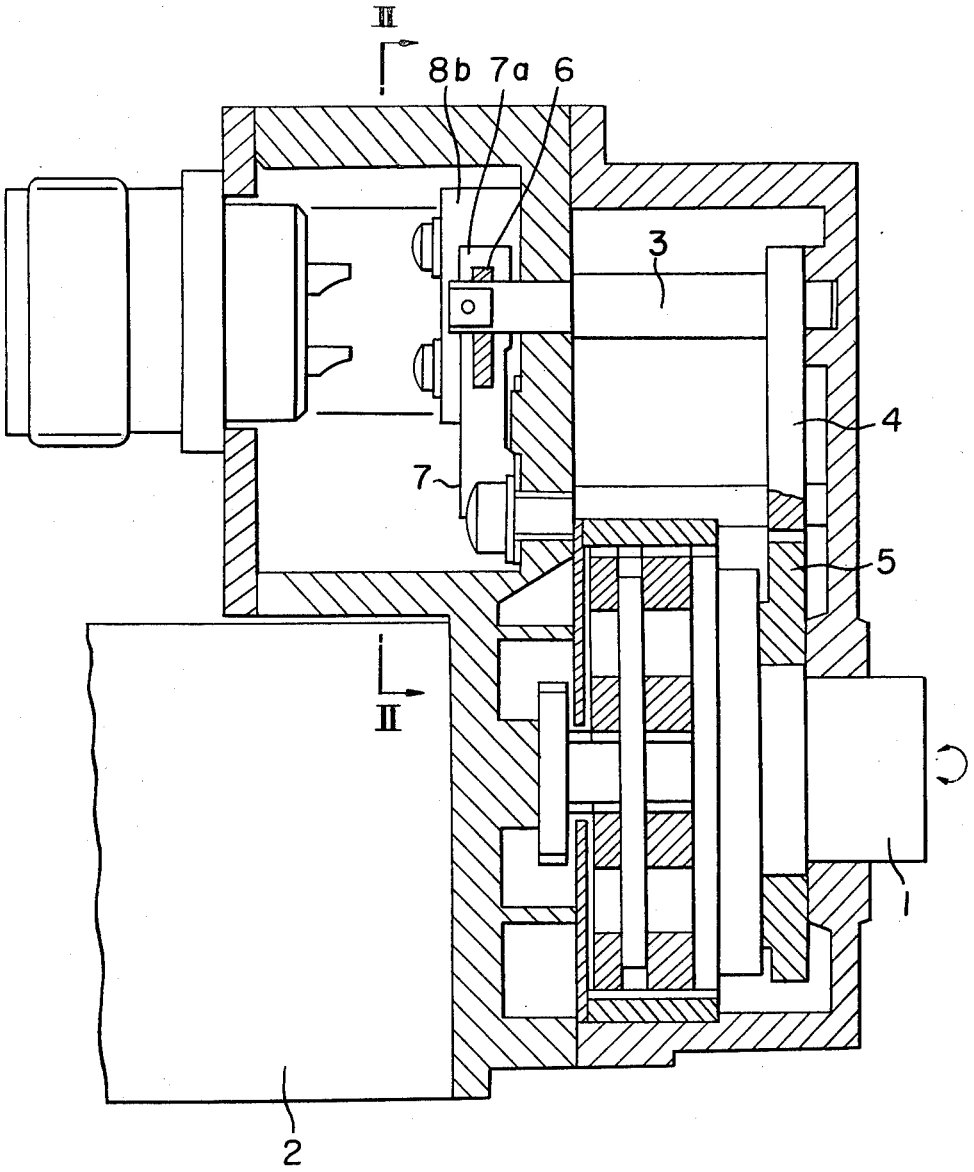
FIG. 1 PRIOR ART
FIG. 1 is a longitudinal cross-sectional view of a conventional limit switch mechanism.
Figure 2:
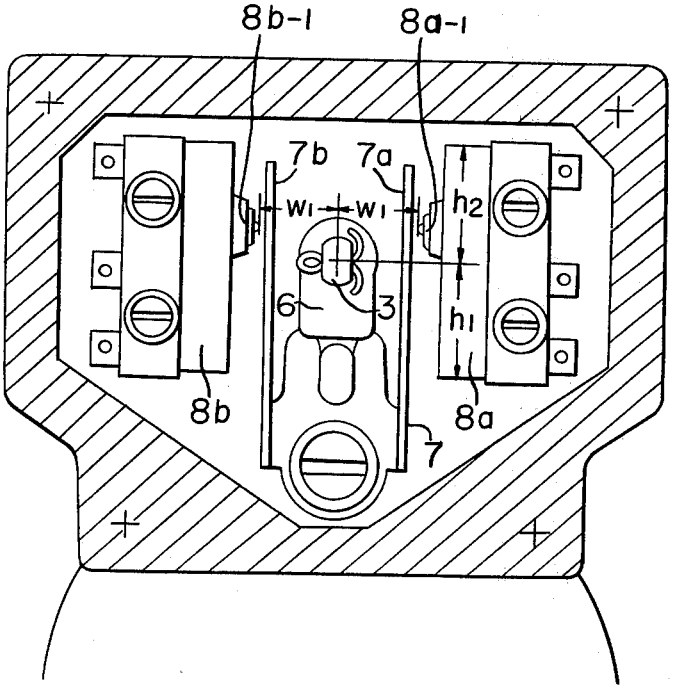
FIG. 2 PRIOR ART
FIG. 2 is a cross-sectional view taken along line II—II of FIG. 1.
Figure 3:
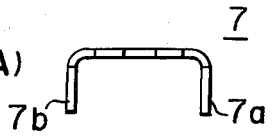
FIG. 3 (A) PRIOR ART
FIG. 3(A) is a plan view, showing switch arms as illustrated in FIGS. 1 and 2.
FIG. 3(B) is a front elevational view of the switch arms of FIG. 3(A)
FIG. 3(C) is a cross-sectional view taken along line C—C of FIG. 3(B)
Figure 3:
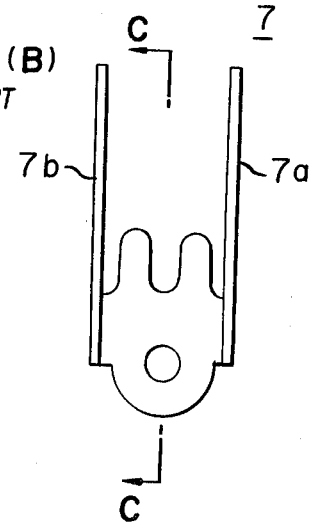
FIG. 3 (B) PRIOR ART
Figure 3:
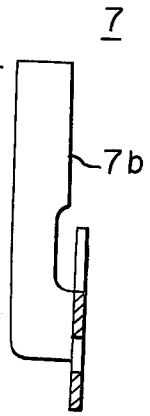
FIG. 3 (C) PRIOR ART
Figure 4:
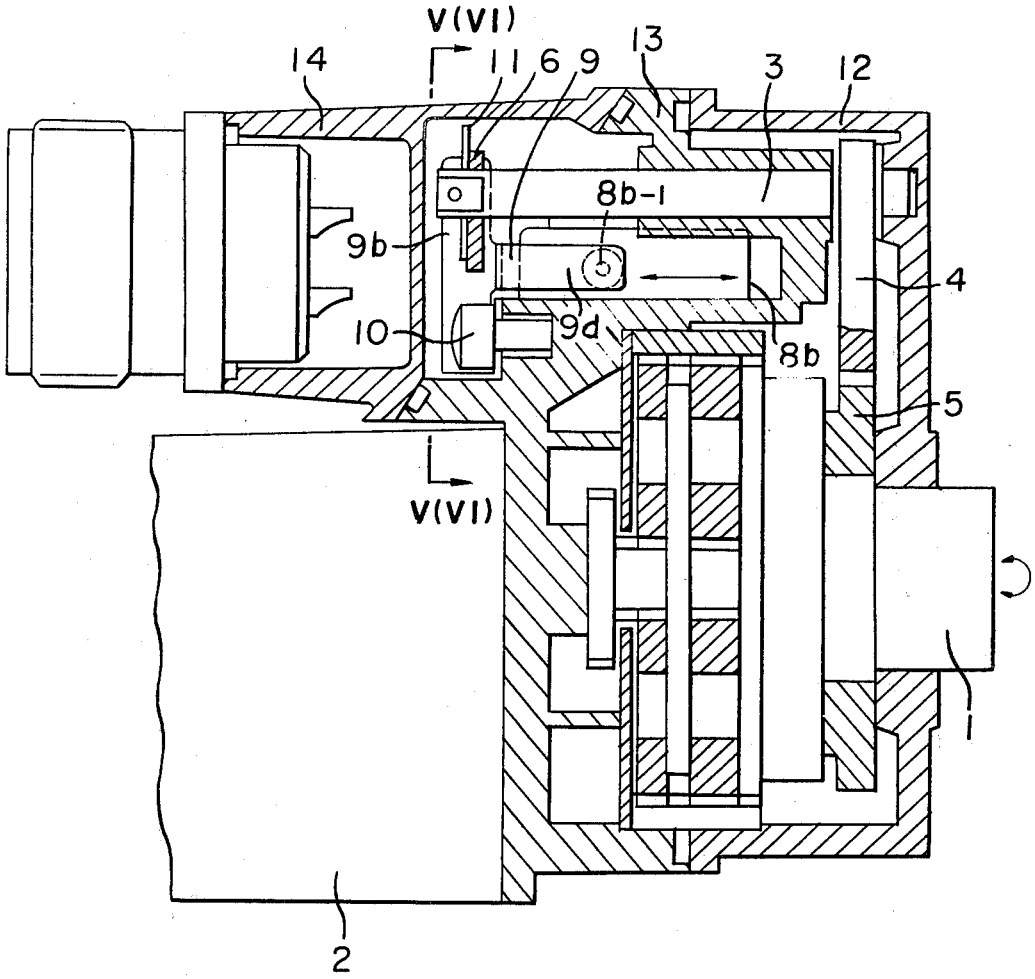
FIG. 4 is a longitudinal cross-sectional view of a limit switch mechanism according to the present invention.
Figure 5:
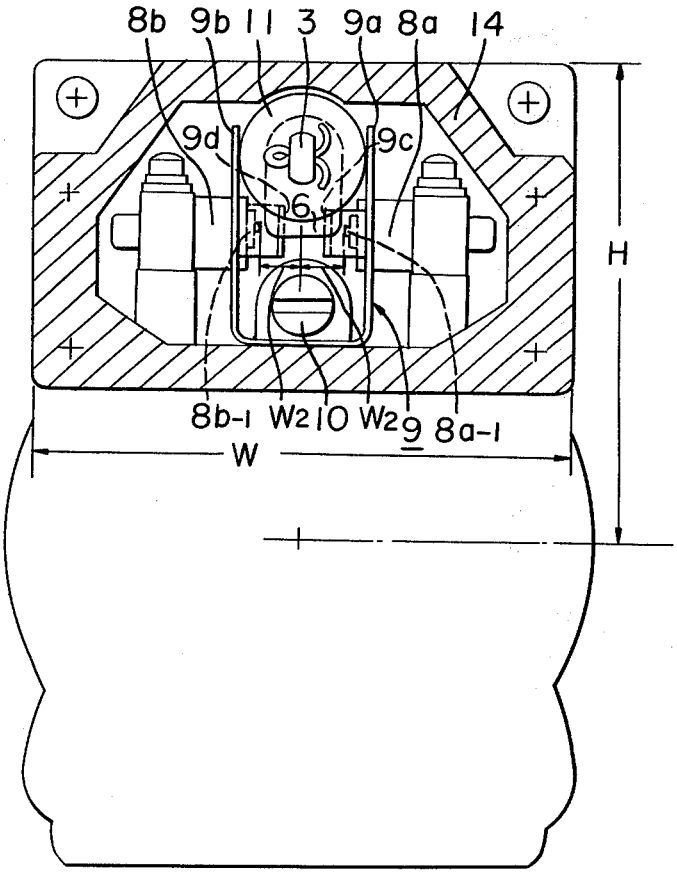
FIG. 5 is a cross-sectional view taken along line V—V (VI—VI) of FIG. 4, showing a pair of limit switches as being in an inoperative position.
Figure 6:
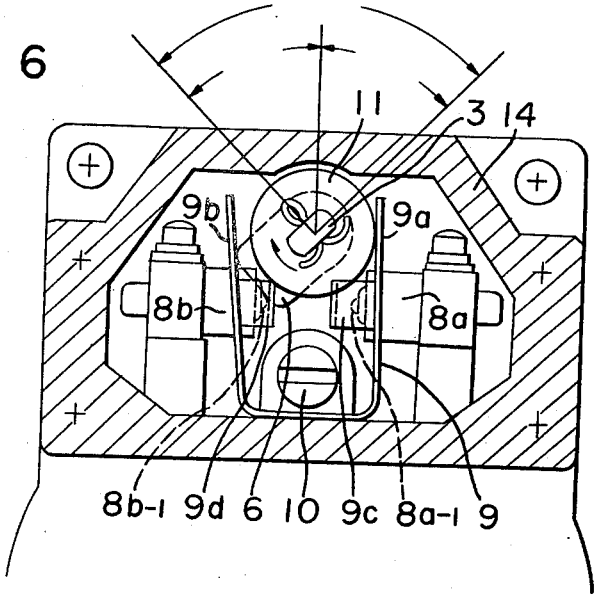
FIG. 6 is similar to FIG. 5, but shows one of the switches being actuated.

The present invention will now be described in detail with reference to FIGS. 4 through 7. Like or corresponding parts shown in FIGS. 4 through 6 are denoted by like or corresponding reference characters illustrated in FIGS. 1 and 2.

A limit switch mechanism according to the present invention includes a pair of limit switches 8*a*, 8*b* having longitudinal and transverse dimensions, the longitudinal dimension extending basically parallel to the axis of a switch drive shaft 3. The limit switches 8*a*, 8*b* are thus disposed longitudinally parallel to each other. As shown in FIG. 4, each of the limit switches 8*a*, 8*b* has a length falling within the length of the switch drive shaft 3, that is, the length between the left-hand end of the switch drive shaft 3 to which a cam 6 is secured and the right-hand end of the switch drive shaft 3 which is operatively coupled to an output shaft 1 through a train of gears 4, 5. The limit switches 8*a*, 8*b* are positioned below the switch drive shaft 3 and disposed close to the latter. Each of the limit switches 8*a*, 8*b* is spaced from the axis of the switch drive shaft 3 by a distance $w_2$ which is smaller than the distance $w_1$ in the conventional limit switch mechanism as described above.

Figure 7A:
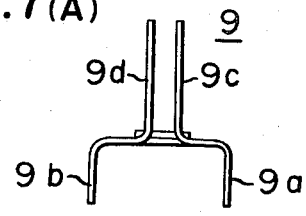
FIG. 7(A) is a plan elevational view, showing switch arms as illustrated in FIGS. 4 and 6.
Figure 7B:
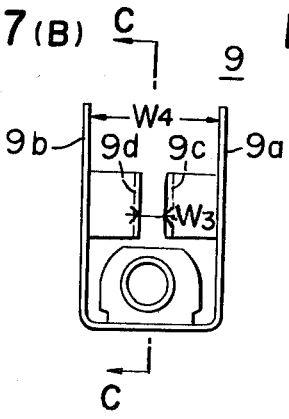
FIG. 7(B) is an elevational view of the switch arm of FIG. 7(A)
Figure 7C:
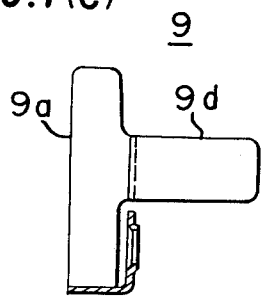
FIG. 7(C) is a cross-sectional view taken along line C—C of FIG. 7(B).

The above disposition of the limit switches 8*a*, 8*b* with respect to the switch drive shaft 3 is rendered possible by a switch drive arm 9 as shown in FIGS. 7(A) through 7(C). The switch drive arm 9 includes a pair of cam arms 9*a*, 9*b* which are actuatable by the cam 6, and a pair of limit switch arms 9*c*, 9*d* which can act on the limit switches 8*a*, 8*b*, respectively, the limit switch arms 9*c*, 8*d* extending from the cam arms 9*a*, 9*b*, respectively. The switch drive arm 9 is secured to a limit switch mechanism body by a screw 10. The cam arms 9*a*, 9*b* are disposed inconfronting relation to the cam 6 and a circular plate 11 fixed to the left-hand end (FIG. 4) of the switch drive shaft 3. The limit switch arms 9*c*, 9*d* are located substantially at central positions of the cam arms 9*a*, 9*b*, respectively, and are bent inwardly into an L-shaped configuration so as to be positioned below the switch drive shaft 3. The limit switch arms 9*c*, 9*d* are spaced from each other by a distance $w_3$ which is smaller than the distance $w_4$ between the cam arms 9*a*, 9*b*. The limit switch arms 9*c*, 9*d* are located in face-to-face relation to pushbuttons 8*a*-1, 8*b*-1 of the limit switches 8*a*, 8*b*, respectively.

The limit switches 8*a*, 8*b* thus arranged to take up a space which is longitudinally and transversely smaller than that in the conventional limit switch mechanism. There is no need to increase the depth of such a space. Thus, the space is relatively small as a whole.

When the motor 2 is energized, the cam 6 is rotated in opposite directions through about 90 degrees as shown in FIG. 6 from the intermediate position as shown in FIG. 5. When the cam 6 is angularly moved clockwise, the cam 6 pushes the cam arm 9*b* of the switch drive arm 9 as shown in FIG. 6 in a direction away from the cam arm 9*a*, whereupon the limit switch arm 9*d* is displaced to deactivate the limit switch 8*b*. Conversely, when the cam 6 is turned counterclockwise, the cam arm 9*a* and hence the limit switch arm 9*c* are displaced away from the cam arm 9*b* to deactivate the limit switch 8*a*. When the limit switches 8*a*, 8*b* are rendered inoperative, a motor power supply is turned off to fully open or close the valve (not shown).

A gear box 12 supports therein the output shaft 1 and the switch drive shaft 3. A housing 13 is coupled to the gear box 12, and suports therein the switch drive shaft 3, the limit switches 8*a*, 8*b*, and the switch drive arm 9. The housing 13 has a left-hand coupling face inclined so that a wide opening is available when a cover 14 is removed for the attachment of the limit switches 8*a*, 8*b*. With the cover 14 detached from the housing 13, the limit switches 8*a*, 8*b* and the switch drive arm 9 can be visually checked for their operation and contacting coaction.

With the foregoing arrangement, the overall housing assembly for accommodating therein the limit switch mechanism can be dimensionally reduced. As an example, the width W in FIG. 5 has been reduced from a conventional width of 54 mm down to 44.5 mm, and the height H has been decreased from a conventional height of 55 mm down to 40.5 mm. Thus, both dimensions can be reduced to less than 45 mm and 41 mm, respectively.

Each of the limit switches is actuatable by a limit switch actuation arm which extends from a cam arm displaceable by a cam on a switch drive shaft and which is located more closely than the cam arm to the switch drive shaft. Thus, the limit switches can be positioned more closely to the switch drive shaft, and hence takes up a smaller space.

The limit switches are disposed so that their length falls fully within the length of the switch drive shaft. Thus, there is no need to increase the longitudinal dimension of the switch drive shaft. An apparatus incorporating such limit switches, such for example as an electrically operated valve, can be smaller in size and more lightweight. Therefore, the limit switch mechanism of the invention is of particular advantage when assembled in apparatus to be installed in airplanes, which are required to be small in size and lightweight.

Although a certain preferred embodiment of the present invention has been shown and described in detail, it should be understood that many changes and modifications may be made therein without departing from the scope of the appended claims.

What is claimed as new and desired to be secured by Letters Patent of the United States is:

1. A limit switch mechanism for coaction with a driver for limiting movement of said driver to a predetermined range, said mechanism comprising:

a shaft rotatable about a first axis and operatively connected to said driver for rotational movement in response to movement of said driver;

a cam mounted on one end of said shaft for movement therewith;

a switch drive arm, said switch drive arm having at least one elastic cam arm positioned so as to be engaged and moved by said cam during rotation of said shaft, and a switch arm movable with each said cam arm, said switch arm having a first portion extending toward said shaft and a second portion extending parallel to said shaft, whereby said switch arm is relatively closer to said shaft than said cam arm; and a switch for each said switch arm, each said switch having at least a longitudinal and transverse dimension and being operative to limit the movement of said driver, the longer of said dimensions extending parallel to said first axis, each said switch having an actuating pushbutton positioned adjacent said second portion of one said switch arms such that said pushbutton is engaged by said second portion upon the movement of said arm by said cam, whereby the width of said mechanism is reduced.

2. The mechanism of claim 1 including two of said cam arms.

3. A limit switch mechanism of claim 1, wherein said cam is affixed to said one end of said shaft, and said shaft has the other end operatively connectable to said driver, said switch having a length smaller than the length of said shaft between said ends thereof.

4. A limit switch mechanism according to claim 1, including a housing having a space in which said switch is accommodated and an opening communicating with said space and defined partly by an edge inclined with respect to said axis of said shaft, and a cover attached to said edge to close said opening.

5. A limit switch mechanism according to claim 4, wherein said housing has a portion supporting said shaft and a portion to which said switch drive arm is fixed.

* * * * *